United States Patent [19]

Eder

[11] 4,124,794

[45] Nov. 7, 1978

[54] ELECTRICAL HEATER UNIT

[76] Inventor: Emil W. Eder, 7912 E. 31st St., Baltimore, Md. 21237

[21] Appl. No.: 799,992

[22] Filed: May 24, 1977

[51] Int. Cl.[2] ..... H05B 3/50; H01C 1/026

[52] U.S. Cl. ..... 219/530; 219/341; 219/342; 219/365; 219/534; 219/540; 338/51; 338/237

[58] Field of Search ..... 219/530, 540, 342, 365, 219/341, 534, 462, 464; 338/234–237, 51

[56] References Cited

U.S. PATENT DOCUMENTS

| | | | |
|---|---|---|---|
| 447,127 | 2/1891 | Butterfield | 338/237 X |
| 620,086 | 2/1899 | Casper | 338/235 X |
| 1,754,232 | 4/1930 | Fisher | 219/365 X |
| 2,196,484 | 4/1940 | Wentworth | 219/462 |
| 2,207,558 | 7/1940 | Singer | 338/237 X |
| 2,215,587 | 9/1940 | Kerschbaum | 338/237 |
| 2,225,850 | 12/1940 | Wright | 219/341 X |
| 2,231,236 | 2/1941 | Wentworth | 219/464 |
| 2,473,783 | 6/1949 | Brown | 219/530 X |
| 2,676,238 | 4/1954 | Coates | 219/540 |
| 2,803,734 | 8/1957 | Germon | 219/534 X |
| 3,353,003 | 11/1967 | Somero | 219/365 |

*Primary Examiner*—A. Bartis
*Attorney, Agent, or Firm*—Walter G. Finch

[57] ABSTRACT

An improved electrical heater using a vacuum surrounding the heating element instead of the usual gaseous or liquid medium for transfer of the heat to external means of dissipation. The heating element, enclosed and sealed in a surrounding encasement which has been evacuated after being sealed, transmits its heat across the vacuum by radiation to the encasement and thence to a series of fins as the means of external dissipation. The heater thereby improves the efficiency of the utilization of the electrical energy used to supply the heat source. The heat dissipating fins are provided with integral spacer lips and are secured on the surrounding encasement by end plates which are formed with downwardly extending portions forming feet on which to stand the heater.

2 Claims, 3 Drawing Figures

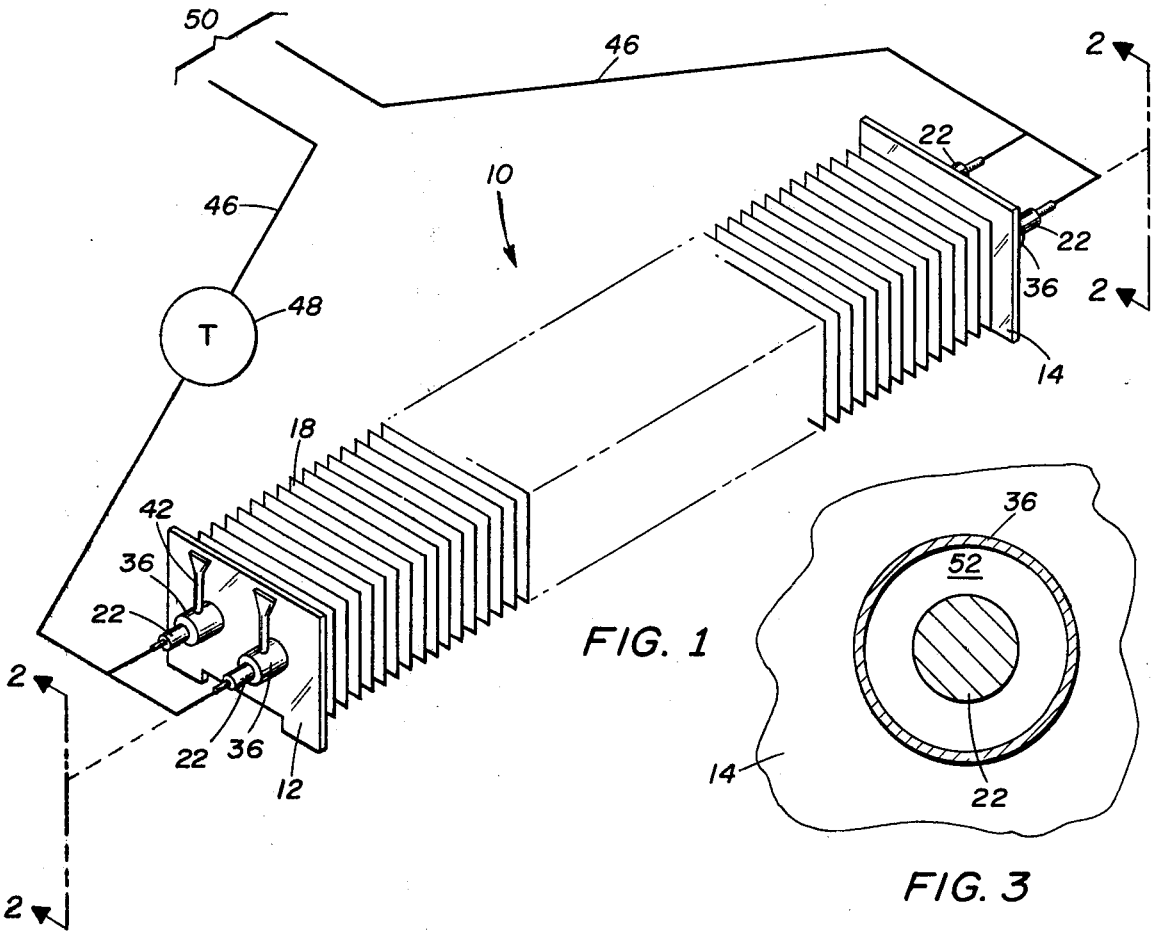
FIG. 1
FIG. 3
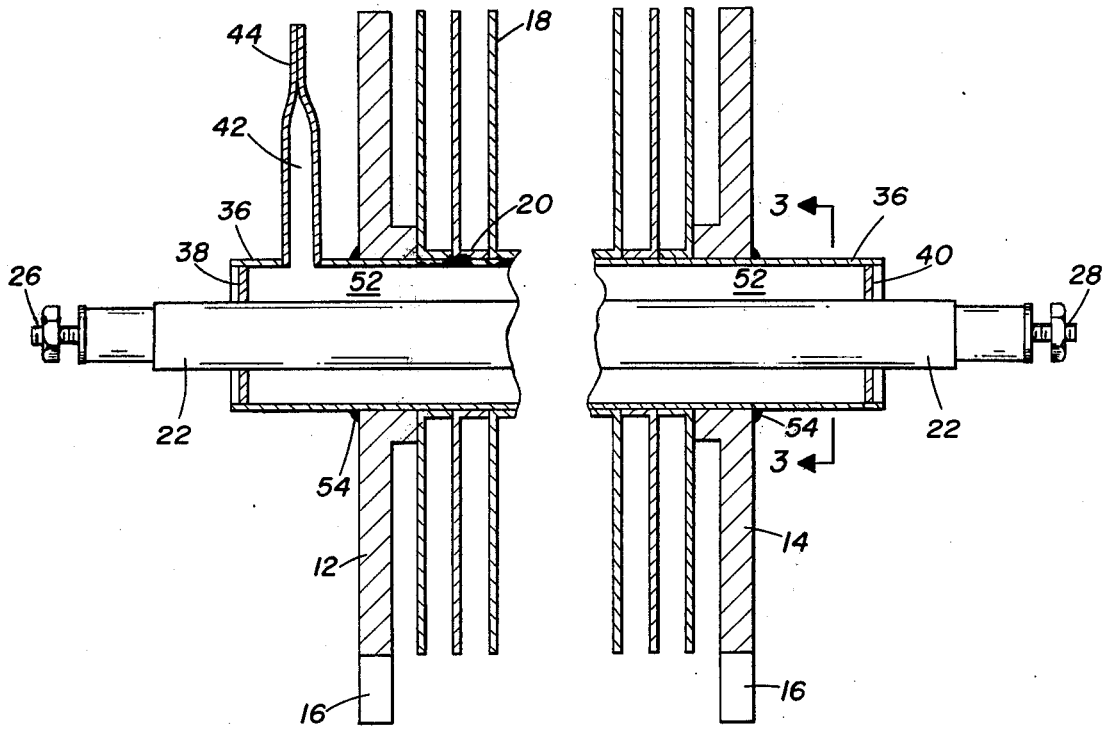
FIG. 2

ELECTRICAL HEATER UNIT

BACKGROUND AND SUMMARY OF THE INVENTION

The invention relates to heaters for space areas in buildings or other enclosures, including residential, commercial, industrial, or other similar structures that require heat for the enclosed space areas.

A need has existed for a way in which energy can be conserved in heating space areas for a long time, but particularly at this time in view of the energy crisis facing the nation. This invention provides a way in which electrical energy can be conserved in those heaters that use electrical energy for providing the energy source for the ultimate heat dissipated in the space area.

Whatever the initial heat source, the losses by conversion to a usable means, and the losses in transmission of the heat to the space areas to be heated, has resulted in an inefficient utilization of that initial energy source.

The present invention provides an efficient means for the transfer of the initial heat expenditure to the final useful heat dissipation in the space areas to be heated. This is accomplished by transmitting the heat emitted by the electrical heating elements directly across a vacuum to an inner surface of a surrounding means which in turn dissipates the heat through a structure of a plurality of fins constructed on the outer surface of said surrounding means.

The heating element assembly as the heat source is centrally located in the surrounding or encasement means which is then sealed and evacuated.

Tube means are attached to the encasement in order to evacuate the sealed encasement to establish a vacuum therein.

The enclosed heating element is connected to an exterior electrical power source. A temperature control system is connected to the connecting means.

The entire structure is provided with end supports on which it is mounted.

It is, therefore, one object of the invention to provide a heating structure means for heating space areas.

It is another object of the invention to provide a heating structure means that surrounds the heating element with a vacuum.

It is yet another object of the invention to provide a heating structure means that contains said vacuum in an enclosure around said heating element.

It is still another object of the invention to provide a heating structure means that dissipates the heat through a plurality of fins mounted on said enclosure for said vacuum.

It is also an object of this invention to provide a heating structure means that is efficient in the utilization of electrical energy as the initial source of heat for said heating structure means.

Further objects and advantages of the invention will become more apparent in light of the following description of the preferred embodiments.

BRIEF DESCRIPTION OF THE DRAWINGS

FIG. 1 is a pictorial view showing the complete electrical vacuum heater;

FIG. 2 is a cross-sectional view 2—2 of FIG. 1;

FIG. 3 is a cross sectional view 3—3 of FIG. 2.

DESCRIPTION OF THE PREFERRED EMBODIMENT

Referring to the drawings and particularly to FIG. 1, an improved electrical heater structure is shown at 10.

In FIG. 1, standard electrical heating element assemblies 22 are shown passing through the heater structure 10. The heating element assembly 22 may also be seen in FIG. 2. A typical standard heating element assembly 22 is one such as the manufactured "chromalox", referred to in U.S. Pat. No. 2,739,219.

As can be seen in FIG. 1, the heating element assemblies 22 are connected to an electrical energy source 50 by electrical wires 46. A temperature control thermostat 48 in the electrical wire 46 system provides the necessary monitoring of the space area temperature, and interrupts the flow of electrical energy as necessary in maintaining the predetermined temperature desired for the space area being heated.

Two heating element assemblies 22 are shown in the drawing, however, it is to be understood that the electrical heater structure 10 may be constructed comprising one or any plurality of heating element assemblies 22.

The heating element assembly 22 is a standard round tubular heating unit, such as the manufactured "chromalox" (referred to in U.S. Pat. No. 2,739,219), but it is to be understood that any similar standard heating unit may be used.

Connections for the electrical wire 46 system is made at the terminals 26 and 28 on the heating element assembly 22.

The aforementioned heating element assembly 22 is encased in outer sealed metal tube 36 with tube end plates 38 and 40 sealing the ends of said metal tube 36 and fixing said heating element assembly 22 in the approximate center thereof. The said seal is a seal at the interfaces of metal tube 36 with metal end plates 38 and 40, and at the interfaces of tube end plates 38 and 40 with heating element assembly 22.

A tube 42 is installed in one end of said outer sealed metal tube 36 for establishing a vacuum 52 inside the outer sealed metal tube 36. When the vacuum is established the end of the tube 42 is sealed off at 44 to maintain the vacuum 52.

The vacuum 52 surrounds the portions of heating element assembly 22 that is within the outer sealed metal tube 36. It is across this vacuum 52 that the heat generated from the heating element assembly 22 is transmitted to the inner surface of the outer sealed metal tube 36, and whereby a more efficient transfer is possible than when a gaseous or liquid medium is used instead of the vacuum provided in this invention.

Heater structure end plates 12 and 14 are secured to the outer surface of the outer sealed metal tube 36 by welds 54. These heater structure end plates 12 and 14 may be of a configuration that provides feet 16 on which to stand the electrical heater structure 10.

It should be understood that the heater structure end plates 12 and 14 may be of any geometrical shape in configuration and need not be provided with feet 16. Any such modification of the configuration as to shape or feet is within the scope and intent of this invention.

In order to dissipate the heat efficiently and quickly into the space area to be heated, a plurality of fins 18 are placed on the outside of the outer sealed metal tube 36. The heat generated by each heating element assembly 22 is transmitted across the vacuum 52 by radiation to the inner surface of the outer sealed metal tube 36, then by conduction to the outer surface of the outer sealed metal tube 36, and thence up through the plurality of fins 18 by conduction.

The heat dissipated into the plurality of fins 18 as aforementioned may be permitted to be dissipated into the surrounding space area to be heated by natural convection of the air movements created by the rising heated air and the induction of cooler air at the base to provide a chimney effect. For greater efficiency a forced air stream may be passed across the fins by a fan means (not shown) to dissipate the heat by convection into the surrounding space area to be heated.

Spacer lips 20 are shown on the fins 18 for spacing the fins in equal distances, however, it is to be understood that loose spacers may be used or no spacer at all. In the latter instance, the fins (without spacer lips or loose spacers) may be pressed on to the outer surface of the outer sealed metal tube 36 to an approximately equal spacing.

The fins 18, individually or with the spacer lips 20, may be fastened to the outer surface of the outer sealed metal tube 36 by welding, brazing, soldering, or other means, or merely left unsecured between the heater structure end plates 12 and 14. The fins 18, with or without spacer lips 20 (or loose spacers) may also be held in place from turning on the outer surface of the outer sealed metal tube 36 by use of a rod (not shown) through the units. It is to be understood that the matter of whether the fins 18 are free or held in place as hereinbefore described is a matter of choice and within the scope and intent of this invention.

It should also be understood that the omission of the heater structure end plates 12 and 14, particularly when other mounting means are to be considered is within the scope and intent of this invention.

The rectangular configuration of the fins 18 is one embodiment. It should be understood that other geometrical configurations may be used without departing from the scope and intent of this invention.

Accordingly, modifications and variations to which the invention is susceptible may be practiced without departing from the scope of the appended claims.

What is claimed is:

1. A space heating structure comprising:

a heat source means consisting of a longitudinally arranged heating element assembly with an electrical terminal at each end by which said longitudinal heating element assembly is connected by electrical wires to an electrical energy source;

said heat source including an outer metal tube encasing said longitudinal heating element assembly, said outer metal tube being cylindrical and of a shorter length than said longitudinal heating element assembly, said longitudinal heating element assembly being centrally located within said outer metal tube in spaced relation thereto with said electrical terminals and the ends of said longitudinal heating element assembly extending from the ends of said outer metal tube, the ends of said outer metal tube being closed by cylindrical metal plates located within the ends of said cylindrical outer metal tube, the ends of said longitudinal heating element assembly with said electrical terminals thereon passing through centrally located openings in said cylindrical metal plates said cylindrical metal plates each being permanently sealed around the outer periphery thereof at the interface with said outer metal tube and each permanently sealed around the periphery of said longitudinal heating element assembly where said cylindrical metal plates and said longitudinal heating element assembly interface thereat, the sealing of said cylindrical metal plates establishing a sealed space between said outer metallic tube and said heating element assembly, said space being evacuated;

a tube connection to said sealed space, said tube connection communicating with interior of the sealed space, said tube being used to evacuate said sealed space to establish a vacuum therein, said vacuum surrounding said longitudinal heating element assembly enclosed within said outer metal tube, said tube connection being pinched off to permanently seal said tube after establishment of said vacuum so as to maintain said vacuum in said space, heat from said longitudinal heating element assembly radiating across said vacuum to the inside of said outer metal tube where it is absorbed and transmitted to exterior of said outer metal tube by conduction;

said heat source being provided with a heat dissipating means consisting of a plurality of spaced rectangular metal fins, said metal fins being set upon the periphery of the exterior of said outer metal tube, the outer metal tube passing through an opening in each of said metal fins, each of said metal fins having a collar-like spacer lip surrounding said opening said spacer lip being on one side only of said metal fin and perpendicular to plane of the face of said metal fin and attached thereto as a continuation of said metal fin, heat conducted to exterior of said sealed outer metal tube being further conducted into and through said metal fins and dissipated to surrounding space by convection; and said heat source being provided with support means comprising a pair of rectangular metal end plates, one affixed to each end of said outer metal tube, said outer metal tube passing through an opening in each of said metal end plates, each of said metal end plates having a collar-like spacer lip surrounding said opening therein, said spacer lip being on one side only of said metal end plate and perpendicular to plane of face of said metal end plate and attached thereto as a continuation of said metal end plate, said metal end plates being so mounted on said outer metal tube so that said spacer lips on said metal end plates are inwardly directed so as to contain said metal fins between them in a closely packed arrangement, said connection tube being located between the end of said outer tube and the other side of one of said end plates, said metal end plates being permanently affixed in the position where said metal fins between said metal end plates are centrally located along the longitudinal length of said outer metal tube, each of said rectangular metal end plates having a rectangularly shaped recess out from lower side thereof to form two legs downwardly extending on which said space heating structure will stand, said legs being opposite to side of sealed outer metal tube from which said tube connection extends.

2. A space heating structure as recited in claim 1, wherein at least two of said heat source means are provided, said heat source means being arranged in spaced side-by-side configuration, wherein said heat dissipating rectangular metal fins of said heat dissipating means embrace all of said heat source means of said side-by-side configuration, and wherein said pair of rectangular metal end plates comprising said support means likewise embrace all of said heat source means of said side-by-side configuration, said longitudinal heating element assemblies of said respective heat source means being connected together in parallel to said electrical energy source by electrical wires.

* * * * *